US009188412B2

(12) United States Patent
Maljkovic et al.

(10) Patent No.: US 9,188,412 B2
(45) Date of Patent: Nov. 17, 2015

(54) POLYMERIC AMMUNITION CASING GEOMETRY

(75) Inventors: Nikica Maljkovic, New Orleans, LA (US); John Francis Bosarge, Pearlington, MS (US); Joe Paul Gibbons, Diamondhead, MS (US)

(73) Assignee: MAC, LLC, Bay St. Louis, MS (US)

( * ) Notice: Subject to any disclaimer, the term of this patent is extended or adjusted under 35 U.S.C. 154(b) by 0 days.

(21) Appl. No.: 13/561,951

(22) Filed: Jul. 30, 2012

(65) Prior Publication Data

US 2014/0076188 A1 Mar. 20, 2014

Related U.S. Application Data

(60) Provisional application No. 61/512,560, filed on Jul. 28, 2011.

(51) Int. Cl.

| | |
|---|---|
| ***F42B 5/307*** | (2006.01) |
| ***F42B 5/02*** | (2006.01) |
| ***F42B 5/34*** | (2006.01) |
| ***F42B 33/00*** | (2006.01) |

(52) U.S. Cl.

CPC . *F42B 5/307* (2013.01); *F42B 5/02* (2013.01); *F42B 5/025* (2013.01); *F42B 5/34* (2013.01); *F42B 33/001* (2013.01)

(58) Field of Classification Search

CPC ..... F42B 5/30; F42B 5/307; F42B 5/02; F42B 5/025; F42B 5/26; F42B 5/313; F42B 5/34; F42B 33/00; F42B 33/001

USPC ..... 102/464, 465, 466, 467

See application file for complete search history.

(56) References Cited

U.S. PATENT DOCUMENTS

| | | | | |
|---|---|---|---|---|
| 3,745,924 | A * | 7/1973 | Scanlon | 102/467 |
| 4,809,612 | A * | 3/1989 | Ballreich et al. | 102/466 |
| 5,259,288 | A * | 11/1993 | Vatsvog | 86/10 |
| 6,283,035 | B1 | 9/2001 | Olson et al. | |
| 6,845,716 | B2 | 1/2005 | Husseini et al. | |
| 7,610,858 | B2 * | 11/2009 | Chung | 102/466 |
| 8,240,252 | B2 * | 8/2012 | Maljkovic et al. | 102/466 |
| 8,408,137 | B2 * | 4/2013 | Battaglia | 102/464 |

(Continued)

FOREIGN PATENT DOCUMENTS

| | | | |
|---|---|---|---|
| DE | 2705235 | A1 | 8/1978 |
| FR | 861071 | A | 1/1941 |
| WO | 2013016730 | A1 | 1/2013 |

OTHER PUBLICATIONS

International Search Report and Written Opinion for International Application PCT/US2012/048848, completed Oct. 12, 2012, 8 pgs.

(Continued)

*Primary Examiner* — James S Bergin
(74) *Attorney, Agent, or Firm* — KPPB LLP

(57) ABSTRACT

An ammunition cartridge casing having a geometry designed to allow for the use of polymeric materials in forming the walls of the cartridge casing of an ammunition article, and methods of reusing such cartridges are provided. More specifically, the ammunition cartridge has a specified ratio between the wall-thicknesses of select portions of an ammunition article's cartridge casing such that polymeric materials may be used in the construction of the ammunition article cartridge casings.

16 Claims, 3 Drawing Sheets

(56) References Cited

U.S. PATENT DOCUMENTS

| | | | | |
|---|---|---|---|---|
| 8,561,543 | B2 * | 10/2013 | Burrow | 102/467 |
| 8,763,535 | B2 * | 7/2014 | Padgett | 102/467 |
| 8,813,650 | B2 * | 8/2014 | Maljkovic et al. | 102/466 |
| 2004/0096539 | A1 | 5/2004 | McCaffrey et al. | |
| 2005/0188879 | A1 * | 9/2005 | Wiley et al. | 102/430 |
| 2006/0207464 | A1 | 9/2006 | Maljkovic et al. | |
| 2007/0261587 | A1 | 11/2007 | Chung | |
| 2010/0282112 | A1 | 11/2010 | Battaglia | |
| 2012/0180687 | A1 | 7/2012 | Padgett et al. | |
| 2012/0180688 | A1 * | 7/2012 | Padgett | 102/466 |
| 2013/0186294 | A1 * | 7/2013 | Davies et al. | 102/467 |

OTHER PUBLICATIONS

International Preliminary Report on Patentability for International Application No. PCT/US2012/048848, International Filing Date Jul. 30, 2012, Search Completed Jan. 28, 2014, Mailed Feb. 6, 2014, 7 pgs.

Extended European Search Report for European Application EP12817294.7, Report completed Aug. 12, 2014, Mailed Aug. 19, 2014, 7 Pgs.

* cited by examiner

POLYMERIC AMMUNITION CASING GEOMETRY

CROSS-REFERENCE TO RELATED APPLICATION

The present application claims priority to U.S. Provisional Application No. 61/512,560, filed Jul. 28, 2011.

FIELD OF THE INVENTION

The present invention generally relates to ammunition articles, and more particularly to two-piece ammunition cartridge cases, where one component is a metallic base or cap which houses a primer and the second component is a polymeric tubular sleeve which constitutes the top portion of the casing and which accepts a projectile at one end.

BACKGROUND

Because of the extreme nature of the application, materials used for fabrication of ammunition cartridges must demonstrate excellent mechanical and thermal properties. As such, the prevalent materials for production of cartridge cases for all calibers of ammunition in the world today are metals. Brass is the leading material, followed in smaller amounts by steel and, in limited amounts, aluminum. Brass, steel, and, to a lesser degree, aluminum cartridge cases suffer from a number of disadvantages, the most important of which are their heavy weight and susceptibility to corrosion. Aluminum has the added disadvantage of potentially explosive oxidative degradation, and is thus used only in low-pressure cartridges or in applications that can tolerate relatively thick casing walls.

Given these issues, desirable materials for ammunition cartridge casing fabrication would be lightweight and impervious to corrosion while having mechanical properties suitable for use in ammunition applications. Many lightweight polymeric materials are sufficiently corrosion resistant; however, to date, polymers have been used only in niche ammunition applications where their inferior mechanical and thermal properties can be tolerated (e.g., shotgun shells, which often contain polyethylene components). While the use of polymeric materials for ammunition cartridge cases has been extensively investigated over the past 40 years, but success has been elusive. Recently new types of polymeric materials have been identified that address many of the mechanical and thermal deficiencies of previous polymeric materials. (See, e.g., U.S. Patent Pub. No. 2006-0207464, the disclosure of which is incorporated herein by reference.)

While progress has been made on possible polymeric materials for use in forming ammunition cartridge casings, a number of engineering challenges remain in adapting conventional ammunition cartridge casing designs for use with these new materials. In particular, weatherability and stability under broad ranges of handling and storage conditions are important, but the greatest mechanical demands on the cartridge are experienced during the firing event. The material at the cartridge base end, which supports the primer, must first absorb the impact of a firing pin on the primer without mechanical failure. Upon ignition and combustion of an encapsulated propellant, rapidly expanding gases create high pressure, which expels a projectile from the barrel of the fired weapon. The ammunition cartridge casing must withstand and contain the pressure developed by the explosion so that the gaseous combustion products expand only in the direction of the barrel opening, thus maximizing energy conversion to projectile kinetic energy.

A weapon's cartridge chamber supports the majority of the cartridge casing wall in the radial direction, but, in many weapons, a portion of the cartridge base end is unsupported. During firing, a stress profile is developed along the cartridge casing, the greatest stresses being concentrated at the base end. Therefore, the cartridge base end must possess the greatest mechanical strength, while a gradual decrease in material strength is acceptable in brass cartridges axially along the casing toward the end that receives the projectile. This is especially important in case of repeating weapons such as machine guns and assault rifles. Often, the cartridges being extracted out of repeating weapons will still contain combustion gas pressure and the round has to be able to withstand extraction event while still being partially pressurized. For reference, typical peak chamber pressures in modern rifles and machine guns are between 35,000 and 70,000 psi. Depending on the cycle time of the individual repeating weapons, the pressure at extraction will vary between 0% and 50% of the peak chamber pressure.

Accordingly, a need exists to develop ammunition cartridge casing geometries optimized for use with modern polymeric materials.

SUMMARY OF THE INVENTION

The current invention is directed to a novel casing geometry for an ammunition article capable of being formed at least partially of a polymeric material.

In some embodiments, the invention is directed to an ammunition article including:

- a casing defining a generally cylindrical hollow body having a cap at a first end thereof and a caselet at a second end thereof, the caselet having a proximal end defining a body region and a distal end defining a neck region, wherein the cap is interconnected with the proximal end of the caselet such that the casing at least partially encloses an internal volume, and wherein the diameter of the caselet narrows from a first diameter at the body region to a second diameter at the neck region;
- a propellant disposed and confined within said internal volume;
- a primer disposed at the first end of the casing in combustible communication with the propellant;
- wherein the caselet at least partially comprises a substantially polymeric material; and
- wherein the ratio of the minimum thickness of the wall of the body region of the caselet to the average wall thickness of the neck region of the ammunition casing, as defined by the middle of its tolerance range, is greater than 1.

In one embodiment, the ratio of the minimum thickness of the wall of the body region of the caselet to the average wall thickness of the neck region of the ammunition casing, as defined by the middle of its tolerance range, is greater than 1.5.

In another embodiment, the ratio of the minimum thickness of the wall of the body region of the caselet to the average wall thickness of the neck region of the ammunition casing, as defined by the middle of its tolerance range, is greater than 2.

In still another embodiment, the casing is one-piece.

In yet another such embodiment, the polymeric material comprises one of either polyphenylsulfone or polycarbonate. In one such embodiment, the polymeric material comprises a polymeric material possessing a glass transition temperature of less than 250° C. In another such embodiment, the polymeric material additionally includes at least one additive selected from plasticizers, lubricants, molding agents, fillers, thermo-oxidative stabilizers, flame-retardants, coloring agents, compatibilizers, impact modifiers, release agents, reinforcing fibers. In still another such embodiment, the polymeric material is one of either a transparent or translucent polymeric material.

In still yet another embodiment, the cap comprises a material selected from steel, aluminum alloy, brass, a magnesium alloy, and a polymer.

In still yet another embodiment, the cap and the caselet are joined using a interconnection selected from a snap fit, threads, snap fit in conjunction with an adhesive, and threads in conjunction with an adhesive.

In still yet another embodiment, the caselet is closed at its distal end and contains no projectile.

In still yet another embodiment, the ammunition casing additionally includes a projectile fitted into the distal end of the caselet. In one such embodiment, the projectile is secured to the casing by an interconnection selected from the group consisting of molding the polymeric material around the projectile, mechanical interference, an adhesive, ultrasonic welding, the combination of molding in place and adhesive, and hot crimping after molding.

In still yet another embodiment, the ratio of the minimum thickness of the wall of the body region of the caselet to the average wall thickness of the neck region of the ammunition casing, as defined by the middle of its tolerance range, is greater than 5 and has less than 70% of the internal volume of a corresponding standard brass case of equivalent caliber. In one such embodiment, the article additionally comprises a projectile fitted in the second end and wherein the projectile's velocity when fired does not exceed 1,086 feet per second at standard atmospheric conditions. In another such embodiment, the projectile is secured to the casing by an interconnection selected from molding the polymeric material around the projectile, mechanical interference, an adhesive, ultrasonic welding, the combination of molding in place and adhesive, and hot crimping after molding. In still another such embodiment, the cap is threadingly interconnected with the caselet such that the ammunition article headspace may be adjusted by rotating the threads clockwise and/or counterclockwise until a desired headspace distance is reached.

In other embodiments, the invention is directed to a method of reusing an ammunition article including:

providing a casing defining a generally cylindrical hollow body having a metallic cap at a first end thereof and a caselet at a second end thereof, the caselet having a proximal end defining a body region and a distal end defining a neck region, wherein the cap is interconnected with the proximal end of the caselet such that the casing at least partially encloses an internal volume, and wherein the diameter of the caselet narrows from a first diameter at the body region to a second diameter at the neck region, the casing having a propellant disposed and confined within the internal volume and a primer disposed at the first end of the casing in combustible communication with the propellant, wherein the caselet at least partially comprises a substantially polymeric material, and wherein the ratio of the minimum thickness of the wall of the body region of the caselet to the average wall thickness of the neck region of the ammunition casing, as defined by the middle of its tolerance range, is greater than 1;

firing the ammunition article; and discarding the fired polymeric caselet, retaining the fired metallic cap and attaching a new polymeric caselet to the existing metallic cap.

In one such embodiment, the cap and casing are threadingly interconnected.

In another such embodiment, the headspace of the ammunition article is adjusted by rotating the threads clockwise and/or counterclockwise until a desired headspace distance is reached.

BRIEF DESCRIPTION OF THE DRAWINGS

The description will be more fully understood with reference to the following figures, which are presented as exemplary embodiments of the invention and should not be construed as a complete recitation of the scope of the invention, wherein.

DETAILED DESCRIPTION

Figure 1:
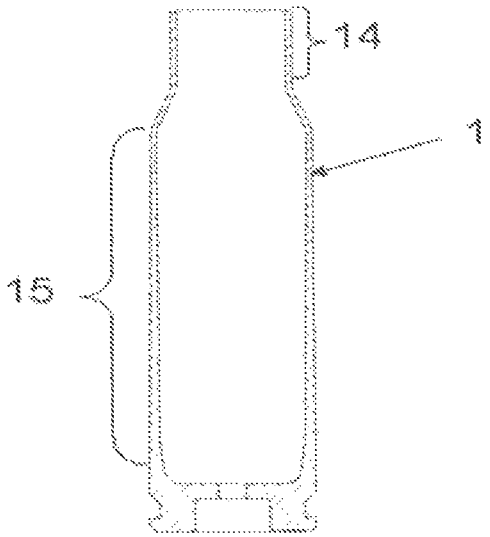
FIG. 1 (PRIOR ART)
FIG. 1 illustrates a cross-sectional schematic of a conventional ammunition cartridge casing.

The current invention is directed to an ammunition cartridge casing having a geometry designed to allow for the use of polymeric materials in forming the walls of the cartridge casing of an ammunition article. More specifically, the current invention recognizes a key ratio between the wall-thicknesses of select portions of an ammunition article's cartridge casing that is necessary for the use of polymeric materials in the construction of ammunition article cartridge casings.

For the purposes of the present invention, the term "ammunition article" as used herein refers to a complete, assembled round or cartridge of ammunition that is ready to be loaded into a firearm and fired, including cap, casing, propellant, projectile, etc. An ammunition article may be a live round fitted with a projectile, or a blank round with no projectile. An ammunition article may be any caliber of pistol or rifle ammunition and may also be other types such as non-lethal rounds, rounds containing rubber bullets, rounds containing multiple projectiles (shot), and rounds containing projectiles other than bullets such as fluid-filled canisters and capsules. The "cartridge casing" is the portion of an ammunition article that remains intact after firing. A cartridge casing may be one-piece or multi-piece.

A typical brass cartridge casing is engineered to reflect the mechanical demands of ammunition by providing a hardness profile along the casing length, with the stiffest and hardest material located at the cartridge base end. In metals, a hardness profile is easily induced by varying the heat treatment conditions from one end of the casing to the other, but this is not an option for polymers. Additionally, although it has complex geometry, the thickness of a brass cartridge case is generally gradually reduced from the primer end toward the projectile end as well, further reducing the stiffness of the structure toward the projectile end. Thus, for example, in 5.56 mm ammunition, a very common ammunition caliber, the wall thickness reaches a minimum of 0.0075" at a point 1.100" from the flash hole (Point 1 in FIG. 1). (For purposes of this application, two regions are defined from FIG. 1; a "body" region 15 (B in FIG. 2) and a "neck" region 14 (N in FIG. 2)). The region between "body" and "neck" region is called the "shoulder" region and although it is shown as having a particular curvature and taper, it should be understood that this is merely illustrative and this shoulder region may be of any geometry.

In addition to reducing the stiffness of the overall structure, this gradual reduction in wall thickness also serves to maximize the interior volume of the cartridge case, allowing for the maximum available space for the ammunition propellant. To this end, generally brass cases have been designed to reach a minimum thickness about ¾ of the length of the cartridge from the primer end 16. Proceeding further toward the projectile end of the cartridge, and depending on the ammunition caliber specifics, there may or may not be a slight thickening of the walls to accommodate the projectile. Regardless of the caliber, however, there is a very narrow range of dimensions commonly employed across all the calibers, and it is here that the polymeric casing geometries of the instant invention diverge from the current state-of-the-art.

The key to the successful performance of the conventional cartridge casing designs has been the fact that the cartridge casing is supported by the weapon chamber walls. The pressure and strains generated during the firing event are transferred through the thin case wall to the thick chamber wall and thus the chamber bears the brunt of the stresses generated during the event. Since polymeric casings enjoy the same weapon chamber support and generally observe the same weapon dynamics to the metallic casings, it has always been expected that the best chance of success would be to mimic the design of successful metallic casings, particularly as they have been optimized and refined over the past century and a half. As a result, though the overall wall thicknesses of polymeric cartridge cases are frequently thicker than metallic cases (principally owing to the constraints of efficient fabrication of ammunition articles formed from polymeric materials) mimicking successful metallic designs was expected to be effective.

Figure 2:
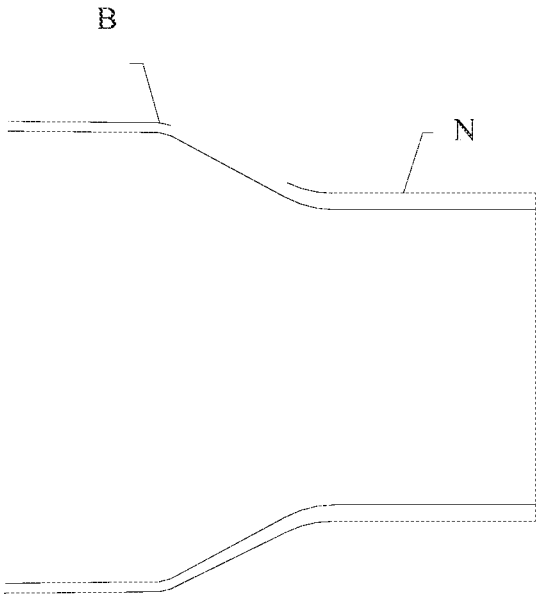
FIG. 2 depicts a cross-sectional close-up schematic of the neck region of an ammunition cartridge casing in accordance with the current invention.

However, it has now been discovered that this pattern does not hold for cartridge cases manufactured out of polymeric materials and that, in order for a polymeric cartridge case to work, a completely different set of design guidelines is necessary. In order to understand the differences, it is necessary to examine the neck and base regions of a cartridge casing near the projectile end in detail. (FIG. 2 illustrates the cartridge case area of interest.) As shown, the area is divided into the following regions: "N" being the "neck" region, and "B" the "body" wall region. Dimensions of interest for the three most common calibers in military and commercial usage are given in Table I below; drawings are for military specification ammunition and are attached.

TABLE I

Conventional Cartridge Case Dimensions

| Caliber | N | B | Ratio B/N |
|---|---|---|---|
| 5.56 mm | 11.5 | 7.5 | 0.65 |
| 7.62 mm | 15 | 13 | 0.87 |
| 50 BMG | 21 | 20 | 0.95 |

(Units are 1/1000 of an inch; values are for minimum wall thickness for B and the middle of the tolerance range for N.)

The calibers highlighted in the table were chosen as representative of the entire spectrum of small caliber necked ("bottlenecked") rifle ammunition. 5.56 mm is placed on the small end of that spectrum, being the most common caliber used in Western military and commercial applications. On the other end of the spectrum is 50 BMG (12.7 mm in metric units), commonly the heaviest small caliber system in military and commercial usage. 7.62 mm (and its close counterpart .308" caliber) sits between the two calibers above and is commonly thought of as a medium-powered small caliber round. Obviously, the selected calibers are not meant to be limiting. Many different types of ammunition articles are provided by the present invention. For example, casings that meet the dimensional requirements of the invention may be used to produce ammunition components for various calibers of firearms. Non limiting examples include .22, .22-250, .223, .243, .25-06, .270, .300, .30-30, .30-40, 30.06, .303, .308, .357, .38, .40, .44, .45, .45-70, .50 BMG, 5.45 mm, 5.56 mm, 6.5 mm, 6.8 mm, 7 mm, 7.62 mm, 8 mm, 9 mm, 10 mm, 12.7 mm, 14.5 mm, 20 mm, 25 mm, 30 mm, 40 mm and others.

An examination of the values in Table I leads to an observation that in conventional ammunition cartridge casings neck thicknesses (N) are in general larger than the body wall thicknesses (B). It is readily apparent from the Table I that this relationship holds across a spectrum of calibers. The ratio of Body Wall Thickness to Neck Wall Thickness (connoted as B/N ratio) is used to conveniently summarize the relationship between the two dimensions. All of the calibers show this Ratio in conventional metal casings to be at or below 0.95, with smaller calibers showing progressively smaller Ratio values.

As discussed previously, these dimensions have always formed the starting basis for any ammunition development effort and they have formed the basis for the development of polymeric ammunition as well. As indicated above, however, it has now been discovered that in order for polymeric ammunition to function properly the values of N and B, and more particularly the Ratio of Wall to Neck Thicknesses (Ratio B/N) has to observe a novel set of guidelines. In particular, it has now been discovered that in order for polymeric ammunition to function properly, the Ratio of B/N has to be larger than 1, i.e. the Body Wall Thickness has to exceed the Neck Wall Thickness. Polymeric ammunition cartridge casings having a wide range of B/N ratios were formed across the range of possible calibers from 5.56 mm to 50 BMG to determine what were the optimal casing geometries for use at each caliber. Tables II-IV, below, show the dimensions of the functional polymeric casings (which are incorporated as embodiments in the instant application) and compares them to the metallic casings of equivalent caliber.

TABLE II 5.56 mm Cartridge Case dimensions

| 5.56 mm | N | B | Ratio B/N |
|---|---|---|---|
| Metallic Case | 11.5 | 7.5 | 0.65 |
| Polymer Case | 13 | 20 | 1.54 |

(Units are 1/1000 of an inch; values are for minimum wall thickness for B and the middle of the tolerance range for N.)

TABLE III 7.62 mm Cartridge Case dimensions

| 7.62 mm | N | B | Ratio B/N |
|---|---|---|---|
| Metallic Case | 15 | 13 | 0.87 |
| Polymer Case | 17 | 41 | 2.41 |

(Units are 1/1000 of an inch; values are for minimum wall thickness for B and the middle of the tolerance range for N.)

TABLE IV

| 50 BMG Cartridge Case dimensions | | | |
|---|---|---|---|
| 50 BMG | N | B (min) | Ratio B/N |
| Metallic Case | 21 | 20 | 0.95 |
| Polymer Case | 23 | 56 | 2.43 |

(Units are 1/1000 of an inch; values are for minimum wall thickness for B and the middle of the tolerance range for N.)

It is immediately apparent that the dimensions of usable polymeric casings differ significantly from their metallic counterparts and it is this difference that is responsible for the functioning of the polymeric casings. In particular, in all of the cases, the Ratio of B/N is larger than 0.95 and this presents the core guideline of this invention.

It is notable that given the extreme nature of the application, a useful design must perform perfectly a great majority of time. Preferably, polymeric cartridge casings will survive more than 99% of live ammunition firings; more preferably, more than 99.9%; even more preferably, more than 99.99%; still more preferably, more than 99.999%. Even higher success rates are more preferable, the most preferable scenario being 100% casing survival. It is also important to note that this design alone is not the only factor guiding the suitability of a given material for polymeric case material, but has to be viewed in the context of additional factors such as material selection, creep resistance, melting and glass transition temperature points, chemical resistance, dimensional stability, particular application requirements, coefficient of friction between the chamber and the case, usage at extreme high temperatures such as 125° F., 140° F. or even 160 and 165° F., extreme low temperatures such as −25° F., −40° F. or even −65° F. and the like.

In order to determine suitable designs for manufacturing of polymeric cartridge casings or casing portions in accordance with the present invention, it is necessary to consider the ratio of the minimum wall thicknesses in the "body" portion ("B") of the ammunition casings to the wall thickness of the "neck" portion ("N") of the ammunition casing, as defined by the middle of its tolerance range. This relationship has been conveniently summarized by the Ratio B/N in Tables I-IV, above. In summary:

Preferably, the designs useful for cartridge casings provided according to practice of the present invention will have Ratio B/N wall thickness greater than about 1.00.

More preferably, the designs useful for cartridge casings provided according to practice of the present invention will have Ratio B/N wall thickness greater than about 1.50.

Most preferably, the designs useful for cartridge casings provided according to practice of the present invention will have Ratio B/N wall thickness greater than about 2.00 or even greater.

Figure 3:
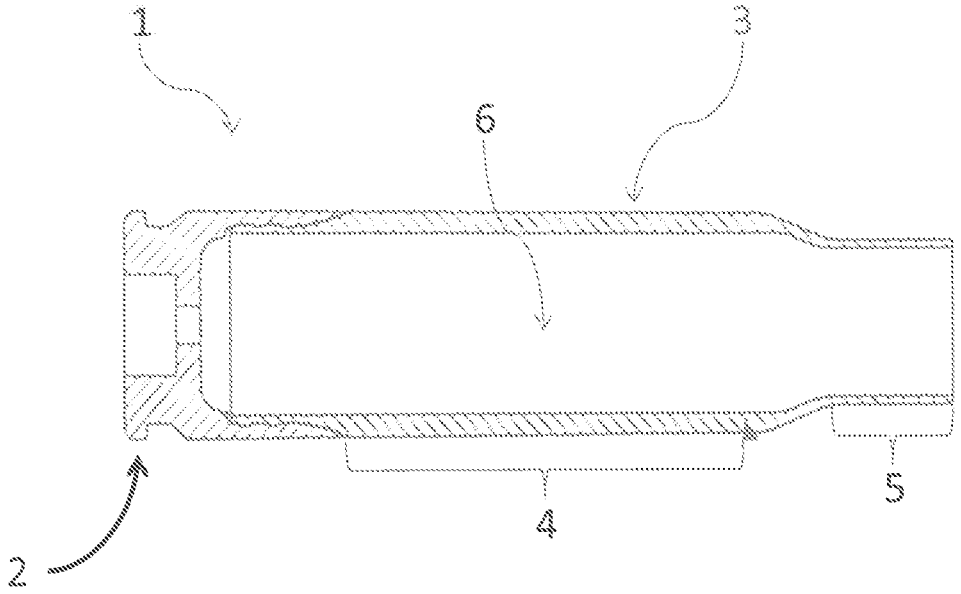
FIG. 3 depicts a cross-section schematic of one embodiment of an ammunition cartridge casing in accordance with the current invention.

In one embodiment of the invention, an ammunition article is provided having a multi-piece cartridge casing (FIG. 3). The casing defines a generally cylindrical hollow body 1 having a cap 2 at a first end thereof and a caselet 3 at a second end thereof, the caselet having a proximal end defining a body region 4 and a distal end defining a neck region 5, wherein the cap is interconnected with the proximal end of said caselet such that the casing at least partially encloses an internal volume 6, and wherein the diameter of the caselet narrows from a first diameter "B" at the body region to a second diameter "N" at the neck region. The cap houses a live primer and is joined securely to the caselet, as will be described below. A propellant charge is introduced into the interior cavity 6 formed by the assembled casing and placed into combustible communication with the primer. A projectile (not shown) may be inserted into the open caselet end and secured as described below, or the open caselet end may be closed to form a blank. In this invention, as described above, the casing must also meet the design requirements that the caselet be at least partially formed of a substantially polymeric material, and that the ratio of the minimum thickness of the wall of the body region of the caselet to the average wall thickness of the neck region of the casing, as defined by the middle of its tolerance range, is greater than 1.

In a preferred embodiment of the present invention, a polymeric caselet is injection molded from a suitable polymeric material, such as polyphenylsulfone (commercially available from Solvay Advanced Polymers, LLC under a trade name of Radel R), polycarbonate (commercially available from SABIC under a trade name of Lexan or Lexan EXL) or polyamide (commercially available from DuPont under a trade name of Zytel). A casing cap is fabricated from aluminum, steel, or brass, and designed to receive a primer. The caselet and cap are securely joined to form the cartridge casing. The casing is loaded with a propellant charge, and a projectile is inserted into the open end and secured.

Many prior art methods are known for attaching the cap and caselet portions of an ammunition cartridge casing. Any method of attaching the caselet and cap is acceptable provided that the two components are joined securely and that gaseous combustion products are not allowed to escape through the assembled casing upon firing. Possible securing methods include, but are not limited to, mechanical interlocking methods such as ribs and threads, adhesives, molding in place, heat crimping, ultrasonic welding, friction welding etc. These and other suitable methods for securing individual pieces of a two-piece or multi-piece cartridge casing are useful in the practice of the present invention.

Turning to the construction of the cartridge case, according to the present invention, polymeric materials may comprise any portion of an ammunition cartridge casing, as long as the Ratio B/N guidance disclosed herein is followed. Because of the more stringent mechanical demands on the bottom or base end of the cartridge as compared to the top end which secures the projectile, a two-piece or multi-piece cartridge casing may be preferred in which one piece is a high strength material that forms the base of the casing, e.g. the base may comprise a metal or a polymeric or composite material. For clarity, base is the portion of the casing that contains the primer and is opposite of the projectile end of the casing, as shown in FIGS. 1 and 3, for example.

Hybrid polymer-metal cartridge casings are well known in the art and are preferred in the practice of the present invention. In a preferred embodiment, a polymeric caselet constitutes the forward portion of a cartridge casing, and a metallic cap forms the closed, rearward casing portion. The proportion of plastic to metal can vary, a larger percentage of plastic being preferred to maximize weight reduction, corrosion resistance, and other advantages of plastics. The amount of metal present is determined by the smallest metal cap size necessary to prevent cartridge failure during firing. Non-limiting amounts of polymeric material in a cartridge casing by weight are about 10%, more preferably about 20%, even more preferably about 30%, still more preferably about 40%, yet more preferably about 50%, even more preferably about 60%, more preferably about 70% and up.

The geometries of some ammunition articles are such that a relatively thick cartridge casing wall can be tolerated, still allowing room for the required propellant charge. Casings for such articles may be of a one-piece polymeric construction, provided that the casing walls can be designed to follow the guidance of the instant application. One-piece polymeric cartridge casings provided according to the present invention are comprised of a polymeric material which meets the mechanical property guidelines of the invention.

In terms of materials, several metals are useful for fabrication of the cap portion of a two-piece ammunition cartridge casing. These include brass and various steel and aluminum alloys and they all work satisfactorily. According to the present invention, the cap portion of the cartridge casings may be made of any material that is mechanically capable of withstanding a firing event. Non-limiting cap materials include any grade of brass, steel and steel alloys, aluminum and its alloys, ceramics, composites, and others. Of course, polymeric or polymer composite materials that are found to have sufficient mechanical properties for use as cartridge caps would also be useful in the practice of the present invention.

Suitable polymeric materials, for both the cap or caselet may be selected from any number of polymeric materials. Non limiting examples include polyamides, polyimides, polyesters, polycarbonates, polysulfones, polylactones, polyacetals, acrylontrile/butadiene/styrene copolymer resins, polyphenylene oxides, ethylene/carbon monoxide copolymers, polyphenylene sulfides, polystyrene, styrene/acrylonitrile copolymer resins, styrene/maleic anhydride copolymer resins, aromatic polyketones and mixtures thereof. Preferred embodiments will be manufactured from any polymer with a glass transition temperature of less than 250° C. Particularly suitable materials include polyphenylsulfones, polycarbonates and polyamides.

Another embodiment of the current invention is the usage of ammunition articles disclosed herein for reloading purposes. Traditional metallic casings can typically be reused for reloading with propellant, primer and projectile to be fired again. This typically entails resizing the cartridge casing, trimming and possibly annealing the cartridge casing. All of these requirements can be bypassed by usage of disposable caselets 2, meeting the guidelines of the current invention in conjunction with a reusable cap 3. As described above, any attachment method capable of joining the two is suitable, although a threaded attachment is preferred. Threads allow for easy assembly and disassembly and also allow for adjustment of the headspace length to accommodate any weapon chamber. (Headspace is defined as the distance from the face of the closed breech of a firearm to the surface in the chamber on which the cartridge case seats. This measurement is one of the critical parameters for functioning of any ammunition article and is particularly important for accuracy.)

An additional embodiment of the current invention is the usage of the casings following the guidelines herein to construct novel subsonic ammunition. Subsonic ammunition is a specialized type of ammunition with projectile velocities of less than the speed of sound. This characteristic of the subsonic ammunition makes it much quieter than the typical, supersonic ammunition. The speed of sound is variable depending on the altitude and atmospheric conditions but is generally in the range of 1,000-1,100 feet per second (fps). The traditional avenue to subsonic ammunition is usage of a reduced quantity of propellant compared to traditional supersonic ammunition. For example, while traditional 7.62 mm ammunition will utilize 40-45 grains of propellant and generate projectile velocities of 2000-3000 fps, the subsonic ammunition would generally use less than about 15 grains of propellant to generate projectile velocities of less than 1070 fps.

The problem with this approach is that the relatively large empty volume inside the case, left vacant by the reduced propellant charge, inhibits proper propellant burn, results in inconsistent propellant positioning, shows reduced accuracy, and, in special situations, may lead to propellant detonation, an extremely dangerous situation for the weapon user. Over the years, a variety of attempts to economically address this issue have been made such as introduction of inert fillers, flexible tubing or foamed inserts. None of these solutions have been successful and the problem is still not fully solved.

One embodiment of instant application provides a solution to this issue. It consists of an ammunition article having a multi-piece cartridge casing. The casing is comprised of a metallic cap portion joined to a polymeric caselet portion, with the caselet having the B/N ratio greater than about 5. The overall casing has less than 70% of the internal volume of the comparable supersonic casing. The cap houses a live primer and is joined securely to the caselet. A propellant charge is introduced into the interior cavity formed by the assembled casing. A projectile is inserted into the open caselet end and secured with adhesive. By constraining the interior volume into which the propellant is to be placed, it is possible to controllably and reliably reduce or eliminate any vacant space within the body of the casing.

Exemplary Embodiments

The person skilled in the art will recognize that additional embodiments according to the invention are contemplated as being within the scope of the foregoing generic disclosure, and no disclaimer is in any way intended by the foregoing, non-limiting examples.

Methods and Materials

Testing polymer cased ammunition produced using the design of the present invention is done by firing fully assembled live ammunition articles. First, designs which have been identified as useful for casing components are molded using standard methods and equipment (e.g., injection molding) to form polymeric cartridge caselets. The caselets are then joined to metallic caps. The resulting cartridges are loaded with a primer and a propellant charge, the type and amount of which can be readily determined by a skilled artisan. A projectile is inserted into the open end of the cartridge and secured by mechanical, adhesive, ultrasonic, vibratory or heat welding or any other suitable method. The article is thus prepared for test firing. Any size, caliber, or type of ammunition article can be assembled for live testing.

Test firing polymer cased ammunition provided by this invention can be performed using any type of firearm corresponding to the size or caliber of the article produced. Ammunition articles can be test fired from a single shot firearm, a semi-automatic firearm, or an automatic firearm. Ammunition may be fired individually or from a clip, magazine, or belt containing multiple ammunition articles. Articles may be fired intermittently or in rapid succession; the rate of fire is limited only by the capabilities of the firearm. Any number of standard brass ammunition articles may be fired prior to loading polymer cased ammunition articles to preheat the firearm chamber for testing under simulated sustained rapid-fire conditions.

EXAMPLE 1

.50 Caliber Testing

Four lightweight polymeric ammunition articles (.50-caliber/12.7 mm) were assembled from injection molded polymeric caselets and caps machined from a steel alloy (P20). Each cap had a pre-installed primer (CCI #35). The caselets were designed with ridges around the rearward portion which created a snap interference fit with corresponding grooves on the cap interior, thus joining the caselet and cap securely. The cartridges were then filled with propellant (235 grains of WC 860). After loading the propellant, the projectiles (647 grains) were inserted into the cartridge and attached using an adhesive. The caselet had the following nominal dimensions: minimum wall thickness (B) of 0.056" ($56\frac{1}{1000}^{th}$ of an inch) and neck thickness (N) of 0.023" ($23\frac{1}{1000}^{th}$ of an inch). The B/N ratio of the design was ~2.4.

After assembling four ammunition articles, the articles were test fired utilizing a single shot, .50-caliber rifle (Serbu BFG-50) instrumented for projectile velocity and chamber pressure measurements. Pressures and velocities were comparable to those obtained when brass ammunition was fired. All four (4) cartridge casings survived the firing intact.

EXAMPLE 2

.223 Caliber Testing

One hundred lightweight polymeric ammunition articles (.223-caliber/5.56 mm) were assembled from injection molded caselets and caps machined from cold headed brass blanks (C26000). Each cap had a pre-installed primer (CCI #41). The caselets were designed with ridges around the lower portion which created a snap interference fit with corresponding grooves on the cap interior, thus joining the caselet and cap securely. The cartridges were then filled with propellant (23 grains of WC 844). After loading the propellant, the projectiles (62 grains) were inserted into the cartridge and attached using an adhesive. The caselet had the following nominal dimensions: minimum wall thickness (B) of 0.020" ($20\frac{1}{1000}^{th}$ of an inch) and neck thickness (N) of 0.013" ($13\frac{1}{1000}^{th}$ of an inch). The B/N ratio of the design was ~1.5.

After assembling one hundred ammunition articles, the articles were test fired in rapid succession utilizing a semi-automatic, .223-caliber rifle (Bushmaster AR-15) instrumented for projectile velocity and chamber pressure measurements. Pressures and velocities were comparable to those obtained using brass ammunition. All 100 cartridge casings survived the firing intact.

Example 3

.308 Caliber Testing

One hundred lightweight polymeric ammunition articles (.308 caliber/7.62 mm) were assembled from injection molded caselets and caps machined from cold headed brass blanks (C26000). Each cap had a pre-installed primer (CCI #34). The caselets were designed with ridges around the lower portion which created a snap interference fit with corresponding grooves on the cap interior, thus joining the caselet and cap securely. The cartridges were then filled with propellant (45 grains of WC 842). After loading the propellant, the projectiles (147 grains) were inserted into the cartridge and attached using an adhesive. The caselet had the following nominal dimensions: minimum wall thickness (B) of 0.041" ($41\frac{1}{1000}^{th}$ of an inch) and neck thickness (N) of 0.017" ($17\frac{1}{1000}^{th}$ of an inch). The B/N ratio of the design was ~2.4.

After assembling one hundred ammunition articles, the articles were test fired in rapid succession utilizing a fully automatic, 7.62 mm machine gun (M240G). All 100 cartridge casings survived the firing intact.

EXAMPLE 4

Fully Automatic .50 Caliber Testing

One hundred lightweight polymeric ammunition articles (.50-caliber/12.7 mm) were assembled from injection molded polymeric caselets and caps machined from cold headed brass blanks (C26000). Each cap had a pre-installed primer (CCI #35). The caselets were designed with ridges around the rearward portion which created a snap interference fit with corresponding grooves on the cap interior, thus joining the caselet and cap securely. The cartridges were then filled with propellant (235 grains of WC 860). After loading the propellant, the projectiles (647 grains) were inserted into the cartridge and attached using an adhesive. The caselet had the following nominal dimensions: minimum wall thickness (B) of 0.056" ($56\frac{1}{1000}^{th}$ of an inch) and neck thickness (N) of 0.023" ($23\frac{1}{1000}^{th}$ of an inch). The B/N ratio of the design was ~2.4.

After assembling one hundred ammunition articles, the articles were test fired at −25° F. in rapid succession utilizing a fully automatic, 50 BMG machine gun (M3M-GAU-21). All 100 cartridge casings survived the firing intact.

EXAMPLE 5

Fully Automatic .308 Caliber Testing

One hundred lightweight polymeric ammunition articles (.308 caliber/7.62 mm) are assembled from injection molded caselets and caps machined from cold headed brass blanks (C26000). Each cap has a pre-installed primer (CCI #34). The caselets are designed with threads around the lower portion which creates threaded connection with corresponding threads on the cap interior, thus joining the caselet and cap securely. The cartridges are then filled with propellant (45 grains of WC 842). After loading the propellant, the projectiles (147 grains) are inserted into the cartridge and attached using an adhesive. The caselet had the following nominal dimensions: minimum wall thickness (B) of 0.041" ($41\frac{1}{1000}^{th}$ of an inch) and neck thickness (N) of 0.017" ($17\frac{1}{1000}^{th}$ of an inch). The B/N ratio of the design was ~2.4.

After assembling one hundred ammunition articles, the articles are test fired in rapid succession utilizing a fully automatic, 7.62 mm machine gun (M240G). All 100 cartridge casings survive the firing intact. Following the first firing, the fired casings are disassembled and spent caselets discarded. The brass caps are re-used in conjunction with new, unfired caselets. The loading and firing procedure is repeated with rounds functioning and surviving intact.

EXAMPLE 6

Subsonic Ammunition Testing

Ten lightweight polymeric ammunition articles (.308 caliber/7.62 mm) are assembled from injection molded caselets, polymeric restrictors and caps machined from cold headed brass blanks (C26000). Each cap has a pre-installed primer (CCI #34). The caselets are designed with ridges around the lower portion which create a snap interference fit with corresponding grooves on the cap interior, thus joining the caselet and cap securely. The cartridges are then filled with propellant (10 grains of WC 842). After loading the propellant, the projectiles (180 grains) were inserted into the cartridge and attached using an adhesive. The caselet had the following nominal dimensions: minimum wall thickness (B) of 0.190"

(41 1/1000th of an inch) and neck thickness (N) of 0.017" (17 1/1000th of an inch). The B/N ratio of the design is ~11.2.

Ammunition articles are fired and projectile velocities recorded. All of the velocities were less than 1,070 feet per second and rounds were all deemed subsonic.

EXAMPLE 7

Conventional Polymeric Ammunition Testing

Four lightweight polymeric ammunition articles (.50-caliber/12.7 mm) are assembled from injection molded polymeric caselets and caps machined from a steel alloy (P20). Each cap had a pre-installed primer (CCI #35). The caselets are designed with ridges around the rearward portion which created a snap interference fit with corresponding grooves on the cap interior, thus joining the caselet and cap securely. The cartridges are then filled with propellant (235 grains of WC 860). After loading the propellant, the projectiles (647 grains) were inserted into the cartridge and attached using an adhesive. The caselet has the following nominal dimensions: minimum wall thickness (B) of 0.021" (21 1/1000th of an inch) and neck thickness (N) of 0.023" (23 1/1000th of an inch). The B/N ratio of the design is ~0.92.

After assembling four ammunition articles, the articles are test fired utilizing a single shot, .50-caliber rifle (Serbu BFG-50) instrumented for projectile velocity and chamber pressure measurements. Pressures and velocities are comparable to those obtained when brass ammunition was fired. Two (2) cartridges show fracture at the body/neck interface while two (2) cartridge casings survive the firing intact.

Doctrine of Equivalents

Those skilled in the art will appreciate that the foregoing examples and descriptions of various preferred embodiments of the present invention are merely illustrative of the invention as a whole, and that variations in the steps and various components of the present invention may be made within the spirit and scope of the invention. Accordingly, the present invention is not limited to the specific embodiments described herein but, rather, is defined by the scope of the appended claims.

What is claimed:

1. An ammunition article comprising:

casing defining a generally cylindrical hollow body having a cap at a first end thereof and a caselet at a second end thereof, the caselet having a proximal end defining a body region and a distal end defining a neck region wherein the cap is interconnected with the proximal end of said caselet such that the casing at least partially encloses an internal volume, and wherein the diameter of the caselet narrows from a first diameter at the body region to a second diameter at the neck region;

a propellant disposed and confined within said internal volume;

a primer disposed at the first end of said casing in combustible communication with said propellant;

wherein the caselet at least partially comprises a substantially polymeric material; and wherein the ratio of the minimum thickness of the wall of the body region of the caselet to the mid-point of the tolerance range of the wall thickness of the neck region of the ammunition casing is greater than 1.5.

2. The ammunition article according to claim 1 wherein the ratio of the minimum thickness of the wall of the body region of the said caselet to the average wall thickness of the neck region of the ammunition casing, as defined by the middle of its tolerance range, is greater than 1.5.

3. The ammunition article according to claim 1, wherein the ratio of the minimum thickness of the wall of the body region of the said caselet to the average wall thickness of the neck region of the ammunition casing, as defined by the middle of its tolerance range, greater than 2.

4. The ammunition article according to claim 1, wherein the polymeric material comprises one of either polyphenylsulfone or polycarbonate.

5. The ammunition article according to claim 1, when polymeric material comprises a polymeric material possessing a glass transition temperature of less than 250° C.

6. The ammunition article according to claim 1 wherein said polymeric material additionally comprises at least one additive selected from the group consisting of plasticizers, lubricants, molding agents, fillers, thermo-oxidative stabilizers, flame-retardants, coloring agents, compatibilizers, impact modifiers, release agents, reinforcing fibers.

7. the ammunition article according to claim 1, wherein the cap comprises a material selected from the group consisting of steel, aluminum alloy, brass, a magnesium alloy, and a polymer.

8. The ammunition article according to claim 1, wherein the cap and the caselet are joined using an interconnection selected from the group consisting of a snap fit, threads, snap fit in conjunction with an adhesive, and threads in conjunction with an adhesive.

9. The ammunition article according to claim 1, wherein the caselet is closed at its distal end and contains no projectile.

10. The ammunition article according to claim 1 additionally comprising a projectile fitted into the distal end of the caselet.

11. The ammunition article according to claim 10 wherein the projectile is secured to the casing by an interconnection selected from the group consisting of molding the polymeric material around the projectile, mechanical interference, an adhesive, ultrasonic welding, the combination of molding in place and adhesive and hot crimping after molding.

12. The ammunition article according to claim 10 wherein the cap is threadingly interconnected with the caselet such that the ammunition article headspace may be adjusted by rotating the threads clockwise and/or counterclockwise until a desired headspace distance is reached.

13. The ammunition article according to claim 1, wherein the ratio of the minimum thickness of the wall of the body region of the said caselet to the average wall thickness of the neck region of the ammunition casing, as defined by the middle of its tolerance range, is greater than 5 and has less than 70% of the internal volume of a corresponding standard brass case of identical caliber.

14. The ammunition article according to claim 13, additionally comprising a projectile fitted in the second end and wherein the said projectile's velocity when fired does not exceed 1,086 feet per second at standard atmospheric conditions.

15. The ammunition article provided according to claim 14, wherein the projectile is secured to the casing by an interconnection selected from the group consisting of molding the polymeric material around the projectile, mechanical interference, an adhesive, ultrasonic welding, the combination of molding in place and adhesive, and hot crimping after molding.

16. The ammunition article according to claim 1, wherein the polymeric material comprises one of either a transparent or translucent polymeric material.

* * * * *

UNITED STATES PATENT AND TRADEMARK OFFICE

CERTIFICATE OF CORRECTION

PATENT NO. : 9,188,412 B2
APPLICATION NO. : 13/561951
DATED : November 17, 2015
INVENTOR(S) : Nikica Maljkovic et al.

It is certified that error appears in the above-identified patent and that said Letters Patent is hereby corrected as shown below:

IN THE CLAIMS

In claim 1, Column 13, line 44, insert --a-- before casing at the beginning of the line Signed and Sealed this
Twenty-ninth Day of March, 2016

Michelle K. Lee

Michelle K. Lee
*Director of the United States Patent and Trademark Office*